United States Patent [19]

Furuta et al.

[11] Patent Number: 4,791,905

[45] Date of Patent: Dec. 20, 1988

[54] CONTROL APPARATUS FOR A VEHICLE ENGINE ELECTRIC FUEL PUMP

[75] Inventors: Kouichi Furuta, Nagoya; Naofumi Fukue; Taku Muguruma, both of Hiroshima; Masato Iwaki, Higashihiroshima, all of Japan

[73] Assignees: Nippondenso Co., Ltd., Aki; Mazda Motor Corporation, Kariya, both of Japan

[21] Appl. No.: 846,076

[22] Filed: Mar. 31, 1986

[30] Foreign Application Priority Data

Apr. 2, 1985 [JP] Japan ..... 60-70672

[51] Int. Cl.[4] ..... F02M 39/00

[52] U.S. Cl. ..... 123/497; 123/494

[58] Field of Search ..... 123/497, 494, 357, 358, 123/359, 495

[56] References Cited

U.S. PATENT DOCUMENTS

| | | | |
|---|---|---|---|
| 3,742,256 | 6/1973 | Frederiksen | 123/497 |
| 3,817,225 | 6/1974 | Priegel | 123/497 |
| 4,260,373 | 4/1981 | Schillinger | 123/497 |
| 4,355,620 | 10/1982 | Seilly | 123/497 |
| 4,359,984 | 11/1982 | Nakao | 123/497 |

FOREIGN PATENT DOCUMENTS

| | | | |
|---|---|---|---|
| 0203854 | 12/1982 | Japan | 123/497 |
| 0015755 | 1/1983 | Japan | 123/497 |
| 58-48765 | 3/1983 | Japan | 123/497 X |
| 58-48766 | 3/1983 | Japan | 123/497 X |
| 58-48767 | 3/1983 | Japan | 123/497 X |
| 58-158365 | 9/1983 | Japan | 123/497 |
| 0172452 | 10/1983 | Japan | 123/497 |
| 59-39960 | 3/1984 | Japan | 123/497 X |
| 1429772 | 3/1976 | United Kingdom | 123/497 |

*Primary Examiner*—Cart Stuart Miller

*Attorney, Agent, or Firm*—Cushman, Darby & Cushman

[57] ABSTRACT

In a dc electric fuel pump control apparatus for controlling the quantity of fuel supplied to a vehicle engine in accordance with an engine operating parameter condition such as an intake air flow condition or engine speed condition, when controlling a voltage applied to a fuel pump operating motor by closing or opening a fixed-resistor short-circuiting switch circuit in accordance with the magnitude of the operating parameter relative to a predetermined value, an increase or decrease of a battery power source voltage from a predetermined value is detected to increase or decrease the predetermined value of the engine operating parameter. Where a variable resistor is used in place of the fixed resistor, its resistance value in a low battery power source voltage condition is controlled lower than that in a high battery power source voltage condition.

10 Claims, 4 Drawing Sheets

CONTROL APPARATUS FOR A VEHICLE ENGINE ELECTRIC FUEL PUMP

BACKGROUND OF THE INVENTION

The present invention relates to a control apparatus for an electric fuel pump adapted for use with engines for vehicles such as automotive vehicles.

In conventional vehicle engines, generally the fuel stored in a fuel tank is supplied by a fuel pump to each fuel injection valve or the float chamber of a carburetor. The fuel is then supplied to the intake system of the engine by the fuel injection valve or the carburetor.

Fuel pumps of the type operated by an electric motor are known in the art, and Japanese Laid-Open Patent Application No. 58-48767 discloses an apparatus for controlling the operation of an engine electric fuel pump as a countermeasure for suppressing the noise caused by the fuel pump during the idling, low load operation or low speed operation of the engine. This control apparatus is designed so that in accordance with the engine operating conditions, e.g., the cooling water temperature, rotation speed and intake air flow of the engine, the applied voltage of the fuel pump operating motor is varied so as to control its rotation speed in accordance with the required fuel delivery of the fuel pump, which varies with the operating conditions of the engine, thereby reducing the fuel pump noise.

However, the control apparatus disclosed in the above-mentioned application is disadvantageous in that since the applied voltage of the fuel pump operating motor is varied in accordance with the operating conditions of the engine, even under the same operating conditions, if the battery is more or less tending to discharge so that the battery voltage is decreased, the applied voltage of the fuel pump operating motor is also decreased, and the rotation speed of the motor is decreased thus decreasing the amount of fuel delivered by the fuel pump. Then, in the worst case, there is the danger of a situation arising in which even the fuel quantity to be consumed by the engine cannot be supplied.

SUMMARY OF THE INVENTION

The present invention has been made to overcome the foregoing deficiencies in the prior art, and it is an object of the invention to provide an electric fuel pump control apparatus which satisfactorily ensures the quantity of fuel delivered to an engine.

To overcome the foregoing deficiencies, in accordance with the invention there is thus provided a control apparatus for an electric fuel pump including voltage condition detecting means for detecting the voltage condition of a battery, and voltage control means responsive to the battery voltage condition detected by the voltage condition detecting means to variably control the voltage applied to a fuel pump operating motor.

DESCRIPTION OF THE PREFERRED EMBODIMENTS

An embodiment of the invention will now be described with reference to the drawings.

Figure 1:
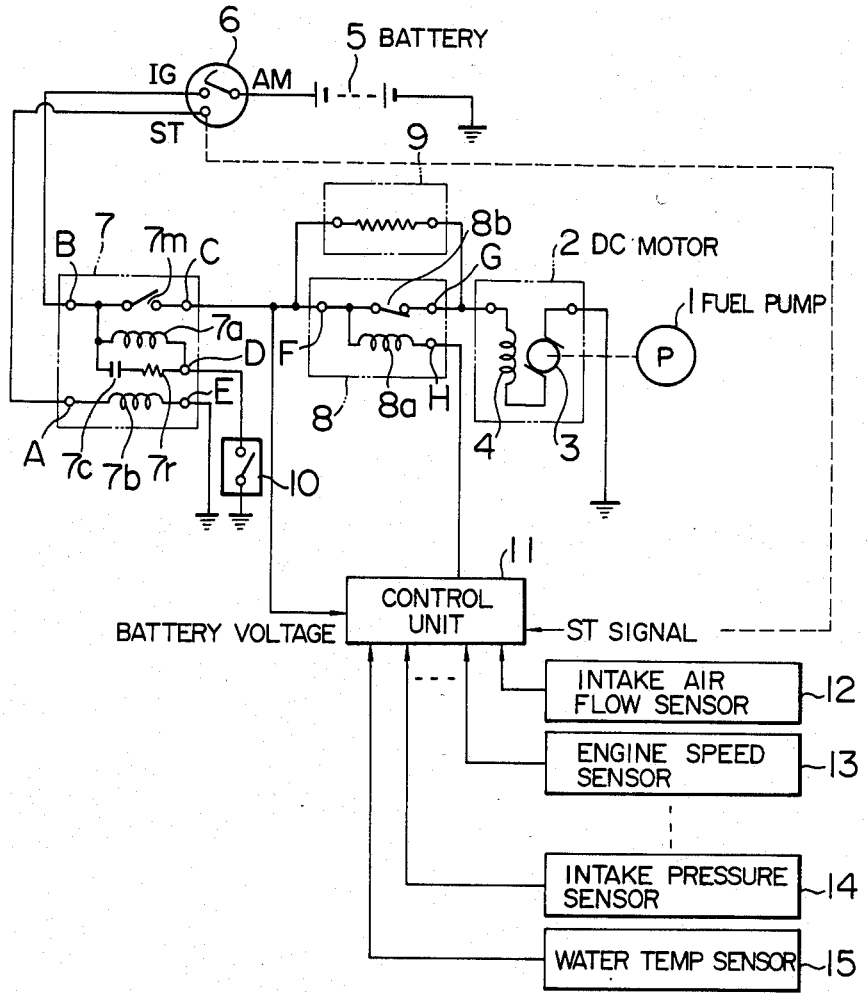
FIG. 1 is an electric circuit diagram showing an embodiment of the invention.

Referring to FIG. 1, there is illustrated an electric circuit diagram of a control apparatus for an electric fuel pump. In the Figure, numeral 1 designates a fuel pump which is operated by a dc motor 2. The dc motor 2 includes an armature 3 and a field winding 4 which are connected in series with each other so that a current is selectively supplied from a battery 5 through an ignition switch 6, a circuit opening relay switch 7 and a parallel circuit of a relay switch 8 and a fixed resistor 9.

The ignition switch 6 includes a terminal AM connected to the battery 5, a starter terminal ST and an ignition terminal IG thus connecting the starter terminal ST to a terminal A of the circuit opening relay switch 7 and the ignition terminal IG to a terminal B of the circuit opening relay switch 7.

The circuit opening relay switch 7 includes a make contact *7m* connected between the terminals B and C, a coil *7a*, a coil protecting capacitor *7c* and a resistor *7r*, which are connected between the terminals B and D, and another coil *7b* connected between the terminals A and E. The make contact *7m* is closed when either one of the coils *7a* and *7b* is energized. The terminal D is grounded through a fuel pump switch 10 and the terminal E is directly grounded. The terminal C is connected to a terminal F of the relay switch 8.

The fuel pump switch 10 is mounted in an intake air flow sensor 12 arranged in the intake system of the engine so that the switch 10 is closed when the intake air flow sensor 12 detects the flow of air.

The relay switch 8 includes a break contact *8b* connected between the terminals F and G and a coil *8a* connected between the terminals F and H, with the terminal G being connected to the dc motor 2 and the terminal H being connected to a control unit 11. The relay switch 8 is a normally closed switch. The terminal C of the circuit opening relay switch 7 is connected to the dc motor 2 through the fixed resistor 9, and terminal C is also connected directly to the control unit 11.

The control unit 11 detects the voltage condition of the battery 5 through its connection with the terminal C of the circuit opening relay switch 7, and it also receives an intake air flow (quantity) Q measured by the intake air flow sensor 12, an engine speed N measured by an engine speed sensor 13, an intake pressure P measured by an intake pressure sensor 14, an engine cooling water temperature THW measured by a water temperature sensor 15, an ST signal coupled to the terminal AM and the starter terminal ST of the ignition switch 6, etc. In response to this data, the control unit 11 controls the energization and deenergization of the coil *8a* of the relay switch 8.

With the construction described above, the operation of the embodiment will now be described.

To start the engine, the terminal AM of the ignition switch 6 is connected to both the ignition terminal IG and the starter terminal ST so that the coil *7b* of the circuit opening relay switch 7 is energized and its make contact *7m* is closed. At this time, the engine is not in operation as yet and the fuel pump switch 10 stays open thus supplying no current to the coil *7a*. At this time, the ST signal is applied to the control unit 11 so that during the time that the ST signal is applied to the control unit 11, the control unit 11 deenergizes the coil 8a of the relay switch 8 and its break contact 8b is closed. Thus, the fixed contact 9 provides no substantial electric resistance and the current from the battery 5 is supplied to the dc motor 2, thereby starting the dc motor 2 to operate the fuel pump 1.

After the engine has started, the terminal AM of the ignition switch 6 is connected to the ignition terminal IG so that since the engine is already in operation at this time, the fuel pump switch 10 is closed and the current is supplied to the coil 7a of the circuit opening relay switch 7, thus causing the make contact 7m to stay closed.

Figure 2:
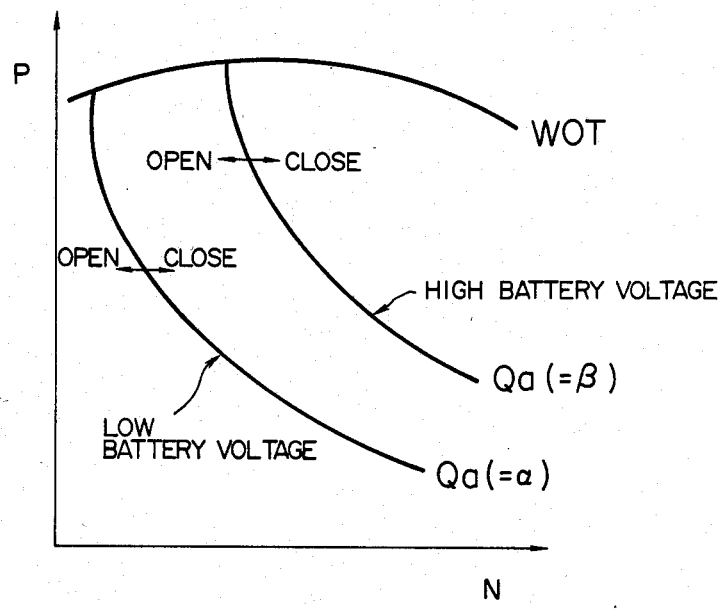
FIG. 2 is a graph showing the on-off lines of the relay switch in reference to the amounts of intake air flow.

Then, after the starting of the engine, the control unit 11 controls the energization and deenergization of the coil 8a of the relay switch 8 depending on whether the intake air flow Q is greater or smaller than a predetermined threshold value Qa. The predetermined threshold value Qa for the intake air flow Q varies with the intake pressure P and the engine speed N as shown in FIG. 2. In the Figure, the curve WOT shows the variation of the intake pressure P with the engine speed N in the wide open throttle condition.

More specifically, when the intake air flow Q is is greater than the predetermined value Qa, the control unit 11 deenergizes the coil 8a of the relay switch 8 so that the break contact 8b is closed and the current from the battery 5 is supplied to the dc motor 2 without the substantial electric resistance being provided by the fixed resistor 9. When the intake air flow Q is smaller than the predetermined value Qa, the control unit 11 energizes the coil 8a of the relay switch 8 so that the break contact 8b is opened and the current from the battery 5 is supplied to the dc motor 2 through the fixed resistor 9. In this way, the voltage applied to the dc motor 2 is controlled so as to control its rotation speed and thereby control the quantity of fuel delivered by the fuel pump 1 in accordance with the operating conditions of the engine.

Also, the predetermined value Qa preset in reference to the intake air flow Q is changed in accordance with the voltage condition of the battery 5 detected by the control unit 11 as shown in FIG. 2. When the voltage condition of the battery 5 is lower than a predetermined value, the control unit 11 changes the predetermined value Qa to $Qa=\alpha$ in reference to the intake air flow Q so that the value of the intake air flow Q is discriminated in reference to the predetermined value $Qa=\alpha$ and the opening and closing of the break contact 8b of the relay switch 8 are controlled correspondingly. When the voltage condition of the battery 5 is higher than the predetermined value, the predetermined value Qa preset in reference to the intake air flow Q is changed to $Qa=\beta$ ($\alpha<\beta$) so that the value of the intake air flow Q is discriminated in reference to the predetermined value $Qa=\beta$ and the opening and closing of the break contact 8b of the relay switch 8 are controlled correspondingly.

Namely, in the lowered voltage condition of the battery 5, the control unit 11 responds to the voltage condition and selects the lower value $\alpha$ as the threshold value Qa, which is predetermined for switching over the opening and closing of the break contact 8b of the relay switch 8 from each other in dependence upon the intake air flow Q and which defines open-close switch-over curves illustrated in FIG. 2. Accordingly, with the intake air flow Q larger than the predetermined smaller value $Qa=\alpha$, the break contact 8b of the relay switch 8 is surely closed even with respect to parameters of intake pressure P and engine speed N plotted in such a region illustrated in FIG. 2 where the break contact 8b of the switch 8 will be opened in the higher voltage condition of the battery 5 for which the control unit 11 selects to set the larger predetermined value $Qa=\beta$. Due to closing of the break contact 8b in the lower voltage condition of the battery 8, the battery current can be supplied directly to the dc motor 2 without passing through the fixed resistor 9, and a voltage is applied to the motor 2 to cause an injection of a sufficient quantity of fuel by the fuel pump 10. Thus, the fuel quantity injected to the engine can be sufficiently procured irrespective of voltage drop in the battery.

While the above-described embodiment is designed so that the predetermined value Qa can be updated to change from $\beta$ to $\alpha$ depending on whether the voltage condition of the battery 5 is higher or lower than a certain predetermined value, it is alternatively possible to preset a plurality of predetermined voltage values for the voltage condition of the battery 5 so that the predetermined value Qa can be updated to change between a plurality of levels in response to the plurality of predetermined voltage values.

Further, while the break contact 8b of the relay switch 8 is opened or closed in reference to the predetermined value Qa for the intake air flow Q, it is possible to control the opening and closing of the break contact 8b of the relay switch 8 by detecting the opening of the throttle valve and determining whether it is more open or closed than a predetermined amount. Also, in the case of an engine having electromagnetic fuel injection valves, the pulse width of electric pulses supplied to the injection valves may be detected so as to control the opening and closing of the break contact 8b of the relay switch 8 in accordance with the pulse width. Also, in consideration of increasing the fuel quanity in accordance with the engine cooling water temperature THW, the predetermined value Qa may be changed in the same manner as it is changed in accordance with the battery voltage.

Figure 3:
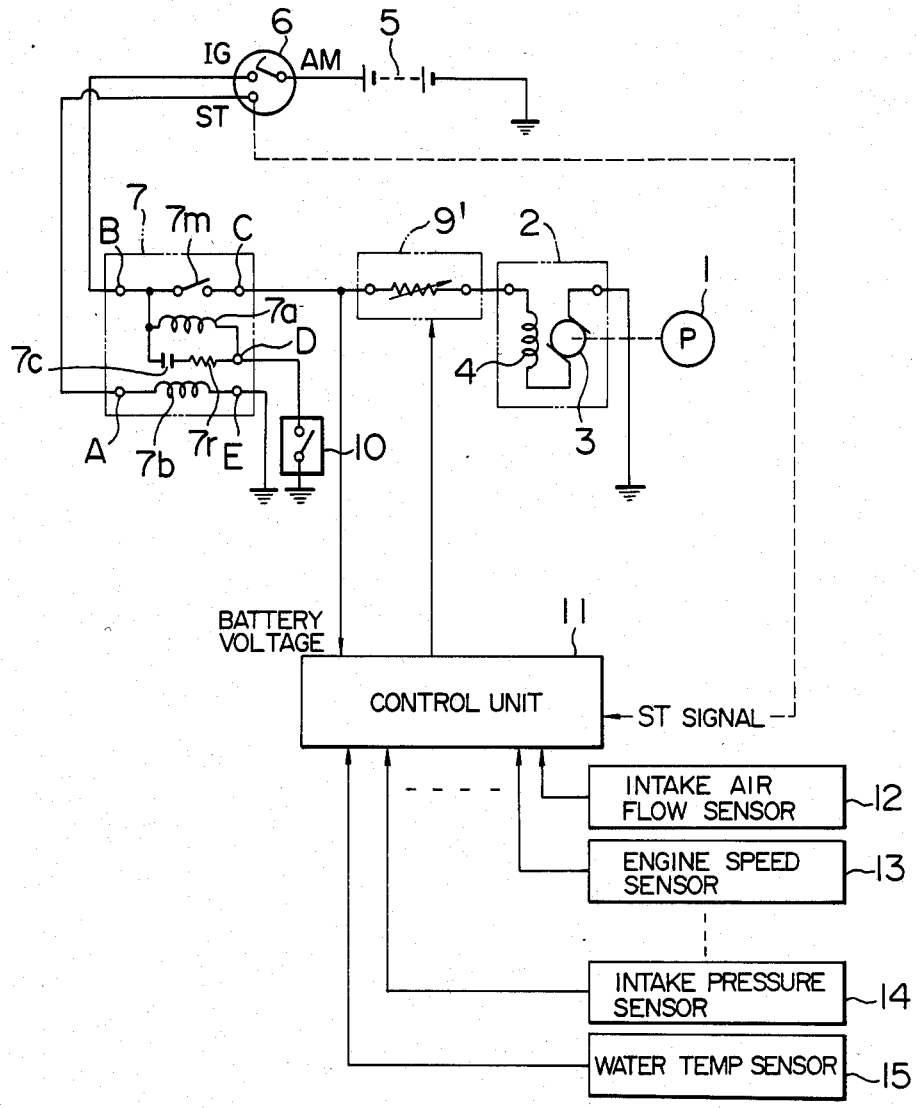
FIG. 3 is an electric circuit diagram showing another embodiment of the invention.

Referring to FIG. 3, there is illustrated a second embodiment of the invention which differs from the first embodiment in that the relay switch 8 is eliminated and the fixed resistor 9 is replaced by a variable resistor 9' whose resistance value R is controlled by the control unit 11. In the Figure, the same component parts as in the first embodiment are designated by the same reference numerals and will not be described.

Figure 4:
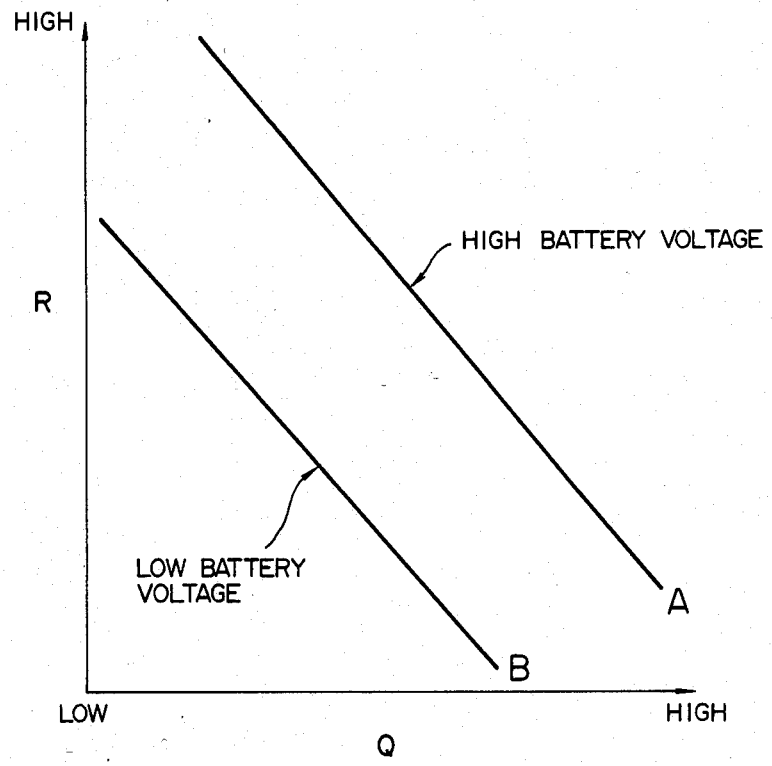
FIG. 4 is a graph showing the change lines for the resistance value of the variable resistor in reference to the amounts of intake air flow.

With the embodiment of FIG. 3, during the engine starting period, the control unit 11 controls the resistance value R of the variable resistor 9' to be at zero or a very small value as along as a signal ST is applied to the control unit 11, whereas when the signal ST is no longer applied, the control unit 11 varies the resistance value R of the variable resistor 9' in accordance with the intake air flow Q as shown by a resistance-change line A or B in FIG. 4.

Also, the control unit 11 changes the change line of the resistance value R of the variable resistor 9' in reference to the intake air flow Q from the line A to the line B in response to the voltage condition of the battery 5. More specifically, when the voltage condition of the battery 5 is low, the resistance value R of the variable resistor 9' is reduced on the whole as compared when the voltage condition of the battery 5 is sufficiently high and the application of a sufficient voltage to the dc motor 2 is ensured.

Namely, in the lowered voltage condition of the battery 5, the control unit 11 responds to the voltage condition and selects the line B to set the resistance value R of the variable resistor 9' in response to the intake air flow Q, so that a resistance value R of the resistor 9' is set lower than that in the case of a higher voltage condition of the battery 5 with respect to like or same quantities of intake air flow Q shown in FIG. 4. Thus, even in the lower voltage condition of the battery 5, a sufficient voltage can be applied to the dc motor 2 to enable injection of a sufficient fuel quantity of the fuel pump 1.

While, in this embodiment, the resistance value R of the variable resistor 9' related to the intake air flow Q is simply changed from the line A to the line B in FIG. 4 in accordance with the voltage condition of the battery 5, a modification may be made such that the change is effected in a stepwise manner, or alternatively, the resistance value R makes a parallel movement between the lines A and B functionally.

Further, the change lines for the resistance value R of the variable resistor 9' are established in reference to the intake air flow Q, and they may be alternatively set in reference to the opening degree of the throttle valve or the pulse width of electric pulses supplied to the injection valves as in the case of the first embodiment. Still further, in consideration of increasing the amount of fuel in accordance with the engine cooling water temperature THW, the change line of the resistance value R of the variable resistor 9' may be changed from one to another in accordance with the cooling water temperature THW.

From the foregoing description it will be seen that in accordance with the invention, by virtue of the fact that an electric fuel pump control apparatus includes voltage condition detecting means for detecting the voltage condition of a battery and voltage control means for variably controlling the voltage applied to a fuel pump operating motor in accordance with the battery voltage condition detected by the voltage condition detecting means, even if the battery voltage condition is low, the application of a sufficient voltage to the fuel pump operating motor is ensured and this in turn ensures the delivery of the fuel from the fuel pump in an amount sufficient relative to the fuel consumption of the engine.

We claim:

1. A control apparatus for an electric fuel pump of a vehicle with an internal combustion engine, comprising:

a battery power source;

motor means for operating said fuel pump in response to power from said power source;

resistor means provided between said power source and said motor means;

switch means connected between said power source and said motor means in parallel with said resistor means;

engine condition detecting means for detecting an engine condition value related to a required fuel quantity of said engine;

voltage detecting means for detecting a voltage condition value of said power source;

switch control means having at least one reference value set beforehand in correspondence to said engine condition value, said switch control means controlling said switch means by comparing said engine condition value with said reference value such that when a relationship between said engine condition value and said reference value represents a condition in which said required fuel quantity corresponding to said engine condition value is larger than a reference required fuel quantity corresponding to said reference value, said switch means is closed, and when said relationship represents a condition in which said required fuel quantity corresponding to said engine condition value is equal to or less that said reference required fuel quantity, said switch means is opened; and reference value changing means for changing, when said voltage condition of said power source is lower than a predetermined setting value, said reference value in said switch control means in a direction in which said engine condition value changes with a decrease in said required fuel quantity.

2. A control apparatus according to claim 1, wherein said switch control means has a first reference value set beforehand which is used when said voltage condition value is equal to or larger than said predetermined setting value, and has a second reference value set beforehand which is used when said voltage condition is lower than said predetermined setting value, and said reference value changing means selects one of said first and said second reference values depending on a comparison result between said voltage condition value and said predetermined setting value.

3. A control apparatus according to claim 1, wherein said switch means includes a coil and a break contact which is opened when said coil is energized and is closed when said coil is not energized.

4. A control apparatus according to claim 3, wherein said switch control means does not energize said coil when the relationship between sad engine condition value and said reference value represents the condition in which said required fuel quantity corresponding to said engine condition value is larger than said reference required fuel quantity, and said switch control means energizes said coil when the relationship between said engine condition value and said reference value represents the condition in which the required fuel quantity corresponding to said engine condition value is equal to or less than said reference required fuel quantity corresponding to said reference value.

5. A control apparatus according to claim 1, wherein said engine condition value represents an intake air flow.

6. A control apparatus according to claim 1, wherein said engine condition value represents an opening degree of a throttle valve.

7. A control apparatus according to claim 1, wherein said engine condition value represents a pulse width of an electrical injection pulse signal applied to an electromagnetic fuel injection valve provided on said internal combustion engine.

8. A control apparatus according to claim 1, further comprising:

temperature condition detecting means for detecting a temperature condition of said engine, wherein said reference value changing means changes said reference value in accordance with said temperature condition by taking into consideration an increase in fuel supplied to said engine in correspondence to said temperature condition.

9. A control apparatus according to claim 8, wherein said temperature condition of said engine represents a temperature condition of cooling water of said engine.

10. A control apparatus according to claim 1, wherein said switch means includes a relay switch having a coil and said engine condition value represents an intake air flow, and wherein said coil is not energized at the time of starting said engine so as to close said relay switch to allow a high voltage to be supplied to said motor means from said battery power source, said coil being energized to open said relay switch when the intake air flow is smaller than a predetermined value indicating a load on said engine is less than an intermediate load, the energization of said coil being interrupted to close said relay switch when the intake air flow is larger than the predetermined value indicating that the load on said engine is high.

* * * * *